US006381337B1

(12) United States Patent
Greenberg

(10) Patent No.: US 6,381,337 B1
(45) Date of Patent: Apr. 30, 2002

(54) SOUND REPRODUCTION DEVICE OR MICROPHONE

(75) Inventor: Marc Adam Greenberg, Northwich (GB)

(73) Assignee: Floating Sounds Limited, Preston (GB)

( * ) Notice: Subject to any disclaimer, the term of this patent is extended or adjusted under 35 U.S.C. 154(b) by 0 days.

(21) Appl. No.: 09/091,044

(22) PCT Filed: Dec. 9, 1996

(86) PCT No.: PCT/GB96/03024

§ 371 Date: Jun. 8, 1998

§ 102(e) Date: Jun. 8, 1998

(87) PCT Pub. No.: WO97/22225

PCT Pub. Date: Jun. 19, 1997

(30) Foreign Application Priority Data

Dec. 9, 1995 (GB) ..... 9525238

(51) Int. Cl.[7] ..... H04R 25/00

(52) U.S. Cl. ..... 381/345; 381/190; 381/423; 381/430; 310/324

(58) Field of Search ..... 310/324, 800; 381/190, 191, 173, 423, 430, 345

(56) References Cited

U.S. PATENT DOCUMENTS 3,947,644 A * 3/1976 Uchikawa ..... 381/334
4,638,207 A 1/1987 Radice
4,704,934 A 11/1987 Nosrati
4,782,471 A * 11/1988 Klein ..... 367/168
4,823,907 A 4/1989 Hoshi
4,843,275 A * 6/1989 Radice ..... 381/334
5,108,338 A 4/1992 Marogolis

FOREIGN PATENT DOCUMENTS

DE 2417962 10/1975

* cited by examiner

*Primary Examiner*—Huyen Le
*Assistant Examiner*—Dionne Harvey
(74) *Attorney, Agent, or Firm*—Ware, Fressola, Van Der Sluys & Adolphson LLP

(57) ABSTRACT

A sound reproduction device or a microphone comprising an enclosure (2) which is made of a substantially gas permeable flexible material and an electrical transducer (1) having at least one connection (4, 5) with the enclosure, and usually two connections, to impart movement to the enclosure where the device acts as a loudspeaker or to receive movement of the enclosure to generate an electrical signal where the device acts as a microphone. The enclosure is adapted to be stressed by internal pressure and forms a concavity centered on at least one of the connections with the electrical transducer, which concavity acts as an acoustic diaphragm.

12 Claims, 3 Drawing Sheets

SOUND REPRODUCTION DEVICE OR MICROPHONE

DESCRIPTION

Figure 1:
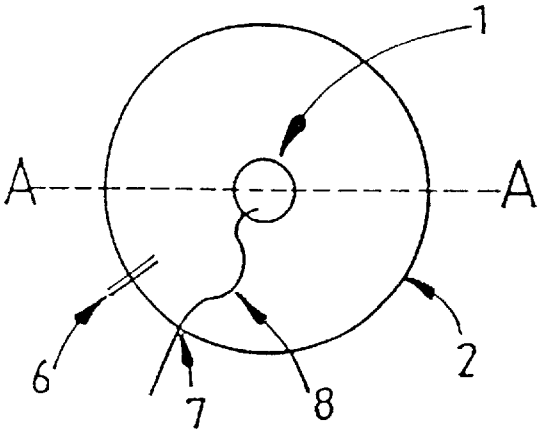

The present invention relates to a sound reproduction device or loudspeaker and especially one employing an electro-acoustic transducer. Another aspect of the invention relates to a microphone.

Loudspeaker driver units in common use today consist of a sound generation device, often a coil or wire in the field of a magnet, that operates a rigid acoustical diaphragm such as a cone. Loudspeakers in common use consist of one or more loudspeaker driver units mounted in a rigid enclosure so that one face of the acoustical diaphragm operates on the inside of the enclosure and other face produces the sound destined for the listener. The enclosure is often substantially air-impermeable although the enclosure may be vented to change the frequency spectrum characteristics of the sound produced. To date, most effort in the field of loudspeakers has been directed at the design of rigid enclosures and rigid acoustical diaphragms.

Whenever a diaphragm moves there is inevitably a region of compressed air at one face of the diaphragm and a region of rarefied air at the other face; indeed it is this property that is exploited in the common loudspeaker to produce sound. However, it is necessary to prevent the region of compressed air meeting the region of rarefied air, because if the two regions of air meet then they tend to cancel each other out and the overall sound level is reduced. In the common loudspeaker the enclosure and the acoustical diaphragm are usually sealed, but sometimes vented as discussed above, in order to prevent the compressed air at one face of the diaphragm reaching the rarefied air at the outer face of the diaphragm. In the common loudspeaker, it is usual for the enclosure and the acoustic diaphragm to be rigid to prevent the region of compressed air expanding into the area of rarefied air by deforming the enclosure or diaphragm.

A rigid enclosure introduces problems. Rigid enclosures must be made of materials such as plastic, metal, wood or wood composites, which are heavy and relatively expensive. The enclosure may be made of many individual pieces of material, tending to increase the cost of manufacture. It is sometimes necessary to reinforce the enclosures to prevent unwanted resonances, this makes the enclosure more difficult to manufacture. When a volume of air is trapped within an enclosure it tends to act as a sort of 'acoustical spring' that resists the movement of the acoustical diaphragm, thereby decreasing the sensitivity of the loudspeaker and limiting its frequency response. A sound absorbing material is often employed inside the enclosure to help to reduce unwanted resonances or reflections, but this can reduce the sensitivity of the loudspeaker. Sometimes the loudspeaker may be weighted in order to further reduce unwanted resonances, but this tends to increase the costs of manufacture and distribution and it reduces the portability of the loudspeaker by the end user.

A rigid acoustical diaphragm also introduces problems. The mass of the diaphragm affects the frequency response and sensitivity of the loudspeaker, low mass diaphragms tend to make loudspeakers with a wider frequency range. Low cost diaphragm materials such as paper and canvas must be treated to increase their rigidity and to prevent absorption of water from the atmosphere, this increases the mass of the diaphragm and therefore reduces the frequency range. Rigid, low mass materials such as fiberglass or carbon fibre tend to cost more than paper or canvas and can be harder to manufacture.

When using a rigid acoustical diaphragm and a rigid enclosure, it is necessary for there to be a flexible coupling between the diaphragm and the enclosure. This coupling is usually made of high performance material that is substantially air-impermeable and must be able to withstand bending through a small radius. The flexible coupling must be able to bend many thousands of times per hour of use and survive the lifetime of the loudspeaker.

Most rigidly encased loudspeakers do not perform well in wet environments, for example if they have vented enclosures then water ingress is a problem. The low cost materials used in loudspeaker cones tend to absorb water, which damages them. Some loudspeaker driver units are provided with cones made of waterproof plastic films, but these tend to have poor sound reproduction qualities in comparison to other materials, and a sealed enclosure is also necessary.

Taking all these effects into account, the common loudspeaker appears to be a less than ideal solution. It would be desirable for there to be a loudspeaker that has an acceptable frequency response and sensitivity but avoids the restrictions of a rigid acoustical diaphragm and a rigid enclosure. That is an aim of the present invention.

Some attempts at flexible loudspeaker enclosures have been made in the past, most notably European Patent EP 0129320A1. This patent describes a flexible enclosure for a loudspeaker, but it relies on two principles, firstly it utilises the rigid cone of a standard loudspeaker driver unit and secondly it relies on the principle that one face of the cone acts on listener and the other face of the cone acts on the inside of the enclosure. The invention described in the above-mentioned patent is intended for use where it is impractical to provide a purpose-built enclosure for a loudspeaker, such as inside voice communication terminals.

The prior art in the form of rigidly enclosed loudspeakers are proven to be effective in domestic and industrial environments alike but they are expensive to manufacture and heavy, this is the opposite of what this invention sets out to achieve.

U.S. Pat. No. 5,108,338 proposes a balloon which has a music producing device, including a small speaker, affixed to the exterior wall of the inflatable balloon by way of an adhesive patch. The patch covers the speaker and mutes the acoustic output. The balloon enclosure itself does not function as an acoustic diaphragm.

Accordingly, one aspect of the present invention provides a sound reproduction device comprising an enclosure and an electrical transducer connected to the enclosure to impart movement thereto to generate sound and wherein the enclosure is made from a substantially air (gas) impermeable flexible material and wherein, for use, the enclosure is adapted to be stressed by internal pressure.

Since all sound reproducing devices (eg. loudspeakers) can be used in reverse as microphones, another aspect of the invention provides a microphone comprising an enclosure and an electrical transducer connected to the enclosure to generate an electrical signal in response to movement imparted thereto from the enclosure and wherein the enclosure is made from a substantially air (gas) impermeable flexible material and is adapted to be stressed by internal pressure.

More generally, the invention provides sound reproduction device or a microphone, comprising an enclosure and an electrical transducer connected to the enclosure to transfer movement therebetween, and wherein the enclosure is made from a substantially air (gas) impermeable flexible material and wherein the enclosure is adapted to be stressed by internal pressure.

Part of the enclosure acts as an acoustic diaphragm. More particularly there are usually two connections of the transducer with the enclosure and at least one of those connections coincides with the centre of a concavity formed in the wall of the enclosure. The concavity acts as the acoustic diaphragm. The formation of the concavity and the overall shape of the enclosure may be influenced by the configuration of the enclosure material. Struts, ties and gussets and/or localised reductions is flexibility of the enclosure material may be utilised to achieve the desired enclosure configuration. The enclosure is in the form of a flexible skin which is relatively thin and conveniently in the form of a film, say of plastics such as polyethylene or mylar. Preferably, a single material is used for the entire enclosure. Stressing is conveniently achieved by filing, eg. inflating, the enclosure with a fluid, for example a gas such as air, helium or carbon dioxide or with a liquid such as oil or water. Alternatively, a semi-solid may be employed. The semi-solid may be an open cell foam, or a jelly-like substance. Access to the interior for filing/inflating is by way of a suitable closable passage which may incorporate a one-way valve.

By using a material which is inflatable, the enclosure can be collapsed and for example folded into a small space when not in use. By using a material which is water impermeable, the loudspeaker can be used outside.

Conveniently the electrical transducer connects with the enclosure at least two locations, and preferably at two opposed locations whereby movements are transferred at both locations. More particularly the filling/inflation of the enclosure is such as to form two or more concavities so that each concavity behaves as an acoustic diaphragm. Each concavity is centred on its connection with the transducer. In the case of a loudspeaker the movement is imparted to the enclosure by the electrical transducers to generate sound, whereas in the case of a microphone the movement of the enclosure is imparted to the electrical transducer to generate an electrical signal representative of the sound.

The electro-acoustic transducer may be of moving coil, moving magnet, piezo-electric, electro-static or any other construction. A particularly simple construction results where a piezo-electric transducer is employed. A piezo-electric transducer has one or more rigid plates separated by a piezo-electric material that exhibits the property of changing thickness when an electric field is applied to it. Accordingly, fixing opposite ends of the piezo-electric transducer to opposite parts of the enclosure provides a means of imparting the sound generating movement to the enclosure. The enclosure may be formed from a piece or pieces of, for example, polyethylene film or more preferably still metalised mylar, which are joined or formed into a closed and inflatable envelope. Where transducers of other types are employed, means is provided for transmitting the motion of the transducers to the flexible enclosure at corresponding locations. Conveniently such other transducers are removed from the enclosure and the motion transmitting mechanism routed into the enclosure with appropriate sealing so that pressurisation of the enclosure is not jeopardised. The inflatable acoustic enclosure of the present invention may be incorporated into other article, especially other inflatable articles.

In the following description, the invention is described with reference to its application as a loudspeaker. For its application as a microphone the reference to "movement being imparted to the enclosure by the electrical transducer" should be read as "movement of the enclosure being imparted to the electrical transducer". Thus, the connection between the electrical transducer and the enclosure could be regarded more generally a movement transfer mechanism.

Figure 3B:
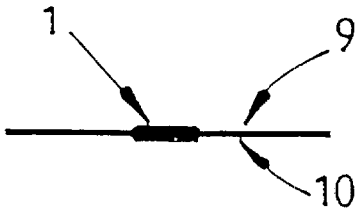
Figure 3A:
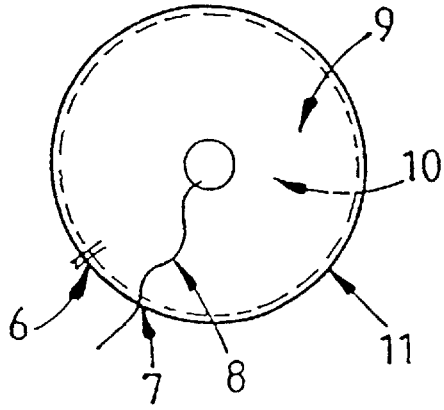
Figure 2:
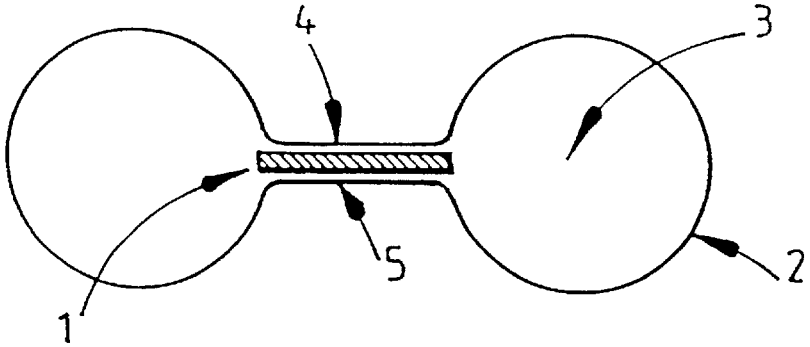
Figure 4:
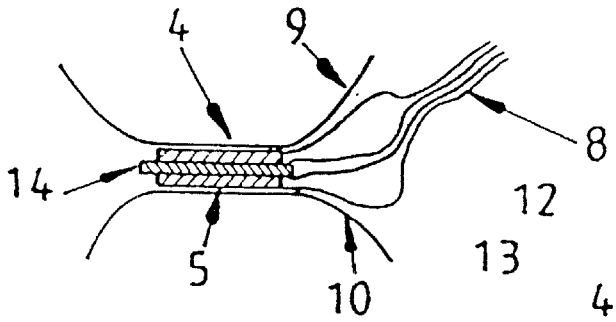
Figure 6D:
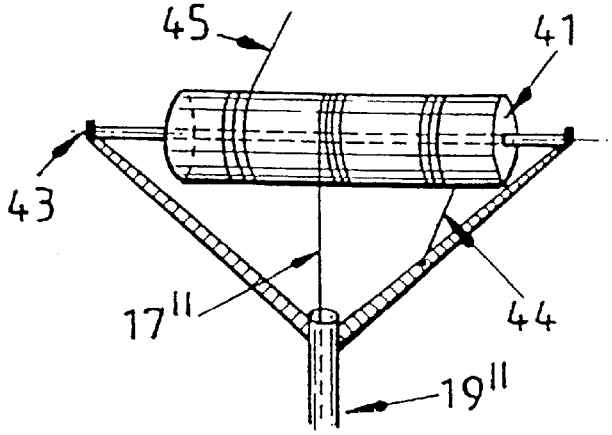
Figure 5:
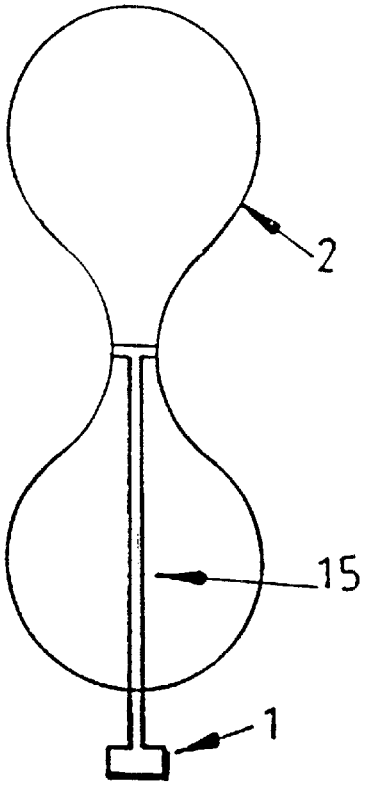
Figure 6C:
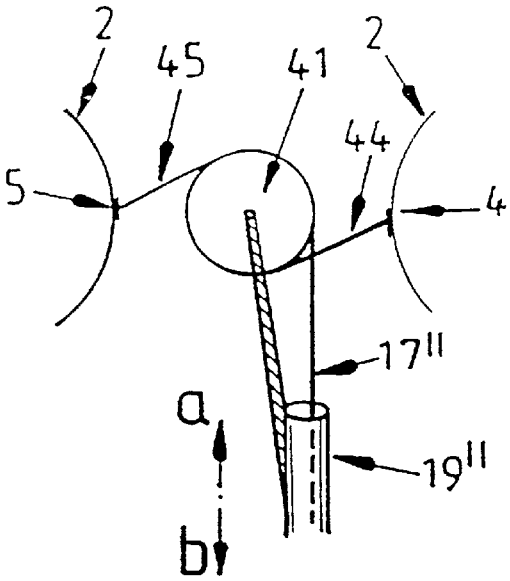
Figure 6A:
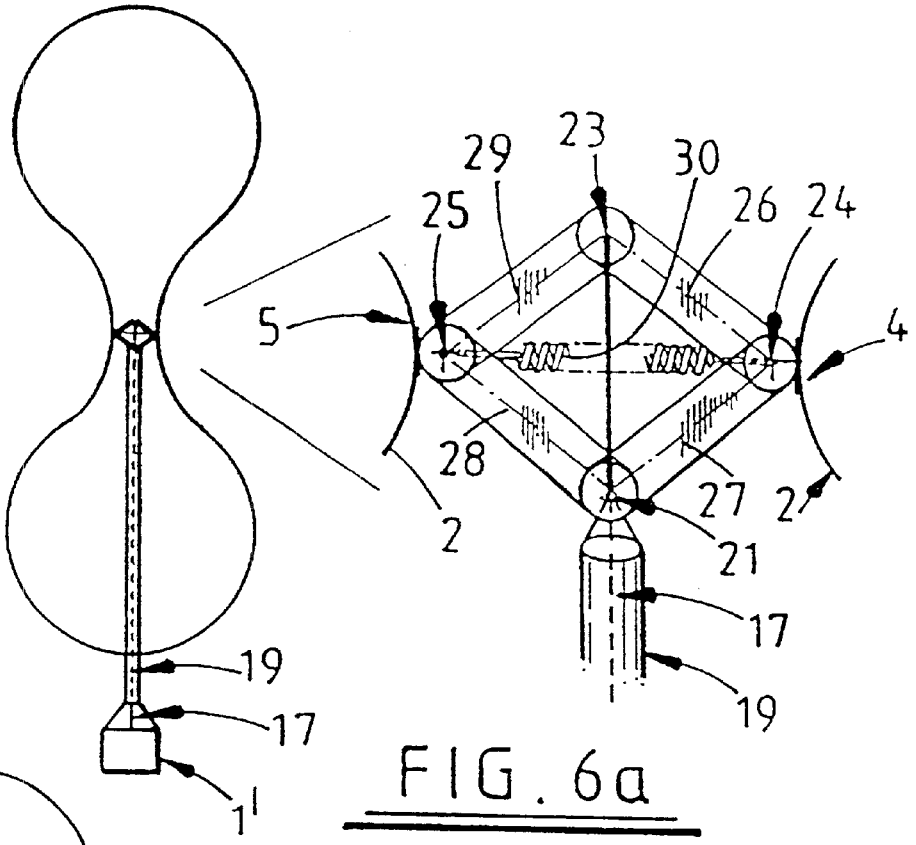

The present invention will now be described further, by way of example only, with reference to the accompanying drawings; in which:

FIG. 1 is a plan view of a self-enclosed sound reproducing device (loudspeaker) in accordance with the present invention, FIG. 2 is a cross-sectional view on line A—A of FIG. 1, FIGS. 3*a* and 3*b* are a plan view and sectional side view respectively of a self-enclosed loudspeaker of FIG. 1 and 2 before filling/inflation, FIG. 4 is a fragmentary cross-sectional view of an embodiment of the invention for reproducing a stereo signal, FIG. 5 is a side view of an alternative embodiment of loudspeaker according to the invention showing provision of the electrical transducer external of the housing, and FIGS. 6*a, b, c* and *d* illustrate in further detail varies alternative mechanisms for translating mechanical movement from a extent transducer to the wall of the flexible enclosure.

Referring firstly to FIGS. 1, 2 and 3, there is illustrated a sound reproduction device according to one embodiment of the present invention.

FIG. 1 shows a flexible enclosure (2) composed of one or more pieces of air-impermeable material. An electro-acoustic transducer (1) is joined to inside the enclosure (2) at one or more locations. Any electrical wires (8) may be led out through a sealed aperture (7) in the enclosure (2). An aperture (6) is left in the enclosure (2) in order to facilitate filling the enclosure (2) and possibly to facilitate fixing the electro-acoustic transducer (1) to the enclosure (2), this aperture (6) is closed when the invention is in operation.

FIG. 2 shows a cross-section through the invention such as could be obtained by separating the invention along the line A—A shown in FIG. 1. FIG. 2 shows the enclosure (2) when filled with a filling (3). The joins between the electro-acoustic transducer (1) and the enclosure (2) can be seen at points (4) and (5), where it can be seen that concavities are formed in the enclosure (2).

FIGS. 3*a* and 3*b* show how an example embodiment of the invention could be constructed. Two circular pieces of polyeurethane film (9 above) and (10 below) of equal size are joined to each other in a continuous circle (11) around their circumferences to form the enclosure marked (2) in FIGS. 1 and 2. At the centre of the enclosure in between the two pieces of film could lie a piezo-electric transducer (1), with the bottom face of the transducer attached to the bottom piece of film (shown as point (5) in FIG. 2) and the top face of the transducer attached to the top face of the film (shown as point (4) in FIG. 2). The wires that connect to the transducer (8) emerge from the enclosure through a sealed hole (7). When the enclosure is inflated, a sphere-like shape is formed (FIG. 1) with the exception of two substantial concavities ((4) and (5) in FIGS. 1 and 2, (9) and (10) in FIG. 3) where the film is joined to the transducer (1). The whole arrangement could be described as a filled toroid or a filled annulus (FIG. 1), a section through the enclosure in a plane running from the top to the bottom of the enclosure (line A—A) in FIG. 1) could he described as having the shape of a 'figure of 8' (FIG. 2). In normal use a device of this type would be mounted, suspended or otherwise such that one of the concavities ((4) and (5) in FIG. 1) points at the listener. Prototypes closely matching this description have been constructed and they perform admirably.

The invention therefore provides a low cost and easy to manufacture enclosure and acoustic diaphragm arrangement for general purpose sound reproduction. Prototypes have exhibited high sensitivity such that the output of a typical 'personal stereo' type radio, cassette or compact disc player provides an acceptable volume for a listener placed a few metres from the invention, when a suitable transformer is used to match the output impedance of the personal stereo to that of the invention. The matching transformer would be unnecessary if a transducer of the correct impedance was available. The low cost of the invention would permit the invention to be sold as a disposable or novelty item for use with 'personal stereos' or perhaps even given away as a promotional item.

The invention could be used instead of rigid loudspeakers in'portable stereo' type radio, cassette or compact disc players where it would have the advantage that it could be deflated while the unit is being transported from one location to another. An automatic or manual method of inflating and deflating the invention could be provided for this application.

Such sound reproduction devices could be used in temporary public address systems in the place of stacks of heavy loudspeakers. This would have the advantage of being easy to set up, take down and transport between locations. Current temporary public address systems can be dangerous as large stacks of heavy loudspeakers can topple and endanger anyone standing below them. The greatly reduced mass of the invention significantly reduces the danger associated with toppling. If the invention were to be filled with helium gas, the risk of toppling could potentially be removed altogether.

In domestic use, the invention is more versatile than rigid loudspeakers because it offers the option of being easily suspended from the ceiling rather than supported on the floor. The invention could also be less obtrusive than rigid loudspeakers by using a clear film for the enclosure.

In industrial, commercial and harsh environments, the invention can easily be suspended from the ceiling due to the low mass of the invention. Tough materials can be used for the enclosure if there is the risk of mechanical damage; a rigid but lightweight perforated enclosure could be provided if there is great risk of mechanical damage.

In the office environment, the 'suspended ceiling' scheme commonly found in offices requires that a hole is cut in the ceiling to accept a conventional loudspeaker driver unit, the hole being the same size as or slightly smaller than the loudspeaker driver unit that is fitted. The invention could be used in the place of conventional loudspeaker driver units. If there is sufficient headroom, the invention could he suspended from the ceiling and it is only necessary to drill a small hole in the ceiling to accommodate the electrical cable.

In wet, outdoor or humid environments, traditional loudspeakers either degrade rapidly or they must be constructed in unusual ways or with unusual materials such that water ingress and water damage is minimised. The materials used in the enclosure for the invention - flexible, air-impermeable materials =- are almost always waterproof and therefore the invention is quite suitable for operation in wet, outdoor or humid environments.

It is also envisaged that a stereo version of the invention could be made by inserting two electro-mechanical transducers in the place of the single electro-mechanical transducer described in the embodiment of the invention above. One transducer would be driven by signals destined for the listener's left ear and the other transducer would be driven by signals destined for the listener's right ear. The two transducers would be bonded together along a common face and each of the other faces of the transducers would act on one side of the diaphragm.

FIG. 4 shows how two piezo-electric transducers might be joined together in an example embodiment of a stereo version of the invention. The piezo-electric transducers (12, 13) are joined together at (14). It may be necessary to insert a mass in the gap (14) to improve stereo separation. A single piezo-electric transducer with piezo-electric coating on two sides could also perform the function of the two transducers (12, 13)). The two transducers would then be joined to two faces of the substantially air-impermeable membrane (4, 5) as in the first example embodiment of the invention. The electrical connections (15) would be routed out of the enclosure in the same way as the electrical connections (8) are routed out of the enclosures in the first embodiment of the design (at point 7)).

In the example embodiments of the invention it may be necessary to insert a matching transformer in the electrical path between the device driving the invention and the invention. Sound amplification equipment in common use tends to have low output impedance because loudspeakers in common use tend to have low input impedance. Piezo-electric transducers, and therefore the example embodiments of the invention, tend to have high input impedances. To ensure sufficient power transfer the impedances of the driver and the driven electrical item must be similar and a transformer is the normal method of circumvention this problem. Another method of circumventing this problem would be to sue sound amplification equipment with high output impedance. Another method of circumventing this problem would be to reduce the impedance of the invention for example by using multiple piezo-electric transducers in each embodiment and making parallel electrical connections to them, or by the use of a single piezo-electric transducer with a low impedance, or by using a single piezo-electric transducer with multiple layers of electrically isolated piezo-electric material and making parallel connections to each layer, or by using a different type of electro-mechanical transducer with a lower characteristic impedance.

The invention has been described above with reference to the use of piezo-electric transducer and where the electro-acoustic transducer is disposed within the enclosure. FIGS. 5, 6*a*, 6*b*, 6*c* and 6*d* describe embodiments where the electro-acoustic transducer is disposed external of the enclosure and a motion transmitting mechanism is employed to communicate movement between the external electro-acoustic transducer and the enclosure.

FIG. 5 illustrates a general arrangement whereby the enclosure when filled/inflated comprises the afore-described enclosure (2) and shows the electro-acoustic transducer (1), for example a moving coil assembly disposed externally of the enclosure and the use of a motion transfer mechanism (15) which enters the enclosure and communicates with the enclosure in two locations. In one embodiment, the electro-acoustic transducer is used to pressurise a fluid or gas which acts on the interior of the enclosure by way of a piston/cylinder assembly. In this way movement is imparted to the enclosure in exactly the same way as with the piezo-electric transducer.

FIG. 6*a* illustrates a possible mechanical linkage for transmitting movement to the walls of the enclosure at the centre of concavities (4) and (5) as previously described. In this instance a moving coil assembly (1') produces relative movement between two elements (eg. an actuator rod (17) and a hollow tube (19)). The relative motion between the two elements is translated into movement in the diaphragm, eg. portions (4) and (5) by the illustrated mechanical linkage. A bottom pivot (21) is attached to the tube (19) and the top pivot (23) is attached to the actuator rod (17). Further pivot points (24, 25) are connected with the pivot points (21, 23) by way of limbs (26, 27) in the case of pivot point (24) and (28, 29) in the case of pivot point (25). The actuator could equally be a wire, cord or the like. Some method of sealing the system would be required, perhaps at the moving coil assembly. By adjusting the dimensions of the linkages it would be possible to employ a mechanical advantage. No stop will be required to prevent the coil being pulled out of the magnet as the mechanical linkage would prevent this. Friction must be avoided as it will generate noise which in turn will be amplified by the diaphragm. A DC bias will be required in normal operation in order to keep the coil in the centre of the magnet and this may be provided electronically or it may be possible to use a spring (30) shown in dotted outline in the illustrated embodiment to achieve this, for example connected between pivot points (24) and (25)

Figure 6B:
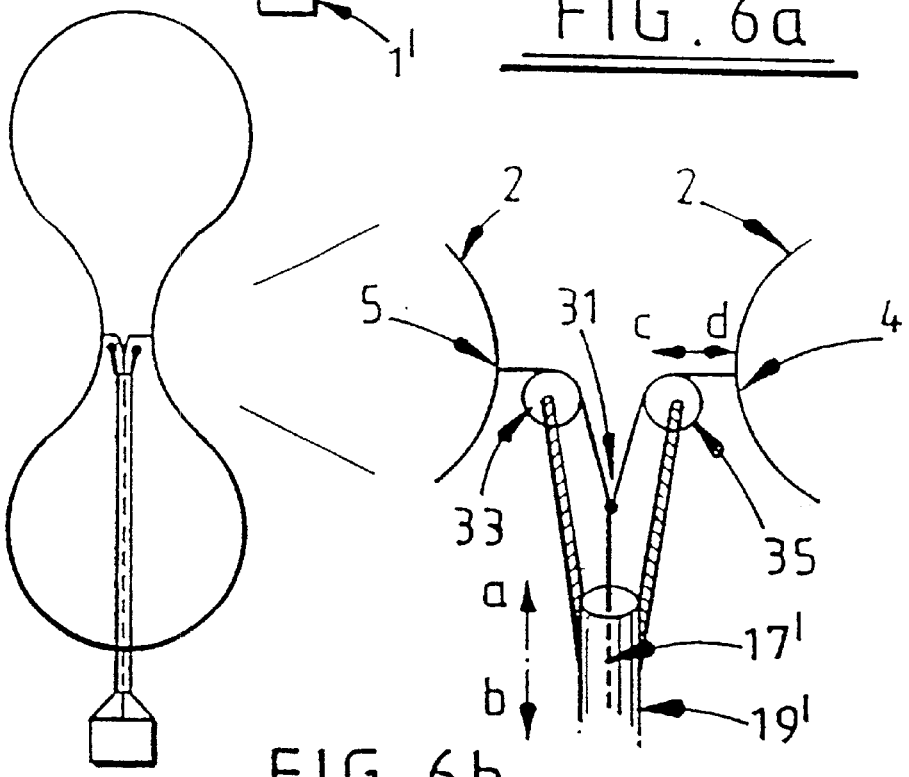

FIG. 6*b* shows an alternative using a flexible linkage similar in effect to the linkage described with reference to FIG. 6*a* but instead a cord (17') is employed and which runs up a tube (19') extending from the acoustic transducer into the enclosure. A further cord or wire (31) has its ends connected to the enclosure at the centre of concavities (4) and (5) as previously and the end of the actuator cord (17') is connected to cord (31). Movement of cord (17') in directions a or b is translated into movement in directions c or d by passing the cord (31) over respective rollers (33, 35) carried at the end of the tube (19'). The rollers may be replaced by a smooth curved surface. This mechanism has the advantage of having a lower mass. A DC bias current m ay be utilised as described above.

Referring now to FIGS. 6*c* and *d* there is illustrated a yet further embodiment of flexible linkage in which motion from the acoustic transducer is conveyed along cord (17") to a roller (41) which is mounted for rotation about an axis(43) on a support taken off connecting tube (19"), thus movement of the cord (17") in directions a or b causes movement of the roller in either a clockwise or anti-clockwise direction. Further cords (44, 45) connect with the roller and with the centre of concavities (4) and (5) respectively whereby movement of the cord (17") is translated to movement of the enclosure to generate sound. The pressurisation within the enclosure will serve as a natural return spring centralising the mechanism.

It will be apparent from the above that numerous alternatives are possible with regard to translating movement to the flexible enclosure and the above are merely provided by way of example only.

What is claimed is:

1. A sound reproduction device or microphone comprising:

an enclosure made from substantially gas impermeable flexible expandable material adapted to be stressed by internal pressure when filled with a filling, the enclosure having an inside surface; and an electrical transducer having at least two connections coupled to the inside surface of the enclosure, the at least two connections, with the inside surface, forming two concavities when the enclosure is expanded by internal pressure by restraining expansion of the enclosure at the at least two connections, each concavity acting as an acoustic diaphragm, and the at least two connections, with the inside surface of enclosure, serving to impart movement thereto to generate sound or to respond to movement of the enclosure to generate an electrical signal.

2. A sound reproduction device or microphone according to claim 1, wherein the enclosure is stressed by filling with a fluid.

3. A sound reproduction device or microphone according to claim 2, wherein the enclosure incorporates an openable and closable filling tube.

4. A sound reproduction device according to claim 1, wherein the enclosure is stressed by the presence of a semi-solid material within the enclosure.

5. A device according to claim 1, wherein the enclosure is collapsible into a substantially flat state corresponding to evacuation of the enclosure.

6. A device according to claim 1, wherein the internal connections of the electrical transducer with the enclosure are by a movement transfer mechanism.

7. A sound reproduction device according to claim 6, wherein the enclosure has two open concavities disposed in opposite relation with the movement transfer device of the electrical transducer interposed therebetween.

8. A device according to claim 1, wherein the electrical transducer is one of a piezo-electric transducer, a moving coil, a moving magnet and a device which operates on an electro-static principle.

9. A device according to claim 1, wherein the electrical transducer is a piezo-electric transducer and is located within the enclosure.

10. A device according to claim 1, wherein the electrical transducer is one of a moving magnet and a moving coil and is disposed external of the enclosures and controls a movement transfer mechanism which is disposed within the enclosure and connected therewith at said two or more connections.

11. A sound reproduction device according to claim 10, wherein the enclosure has two open concavities disposed in opposite relation with the movement transfer device of the electrical transducer interposed therebetween.

12. A sound reproduction device according to claim 1, wherein the enclosure has two open concavities disposed in opposite relation with the electrical transducer interposed therebetween.

* * * * *

UNITED STATES PATENT AND TRADEMARK OFFICE

CERTIFICATE OF CORRECTION

PATENT NO. : 6,381,337 B1
DATED : April 30, 2002
INVENTOR(S) : Marc Adam Greenberg It is certified that error appears in the above-identified patent and that said Letters Patent is hereby corrected as shown below:

Title page,
Item [56], References cited, "Marogolis" should be -- Margolis --.

Signed and Sealed this

Twenty-fifth Day of February, 2003

JAMES E. ROGAN
*Director of the United States Patent and Trademark Office*